US006722071B1

(12) United States Patent
Lin

(10) Patent No.: US 6,722,071 B1
(45) Date of Patent: Apr. 20, 2004

(54) TRIGGER LOCK

(76) Inventor: Chin-Tung Lin, 4Fl., No. 161, Syuan Rd., Shinjuang City, Taipei Hsien (TW)

( * ) Notice: Subject to any disclaimer, the term of this patent is extended or adjusted under 35 U.S.C. 154(b) by 0 days.

(21) Appl. No.: 10/420,906

(22) Filed: Apr. 23, 2003

(51) Int. Cl.[7] ..... F41A 17/00
(52) U.S. Cl. ..... 42/70.07; 42/70.11
(58) Field of Search ..... 42/70.07, 70.06, 42/70.11

(56) References Cited

U.S. PATENT DOCUMENTS 4,499,681 A * 2/1985 Bako et al. ..... 42/70.07
5,437,119 A 8/1995 Womack
5,535,605 A * 7/1996 Werner ..... 70/14
5,918,402 A 7/1999 Weinraub
6,055,759 A * 5/2000 Langner ..... 42/70.07
6,457,272 B1 10/2002 Weinraub
6,474,238 B1 11/2002 Weinraub
6,601,332 B1 * 8/2003 Riebling ..... 42/70.11

* cited by examiner

*Primary Examiner*—Michael J. Carone
*Assistant Examiner*—M. Thomson
(74) *Attorney, Agent, or Firm*—Birch, Stewart, Kolasch & Birch, LLP

(57) ABSTRACT

An blocking apparatus for gun trigger includes a main body of lock and a locking plate. The locking body is composed of a lock cylinder and a locking piece disposed inside a plastic core, then covered by a metal casing and a metal panel. The surface thereof is coated with a waterproof layer by injection molding. The locking plate has two locking rods installed on a metal plate. The surface of the locking plate is also covered with a waterproof layer by injection molding. The two locking rods on the metal plate are inserted into two inserting holes on the locking body so as to lock the trigger of gun.

2 Claims, 10 Drawing Sheets

TRIGGER LOCK

BACKGROUND OF THE INVENTION

1. Field of the Invention

The present invention relates to a gun trigger lock, especially to a lock having a main body and a locking plate, respectively mounted on opposite sides of the trigger and trigger guard so as to prevent the illegal use and for gun safety.

2. Description of the Prior Art

Generally, in many countries, it's easily to purchase guns for self-defense or guarding according the laws and regulations. Although it's legal to have guns in many countries, registration is necessary when purchased the weapons, so they could be traced if necessary. Once the criminals want to commit crimes, they get to steal other's firearms so as to avoid the tracing. Once people's guns are stolen or robbed, it will be misused and thus causes users a lot trouble. It's necessary to have a device to stop the misuse of guns by the criminals.

Refer to U.S. Pat. Nos. 5,918,402, 5,437,119, 6,474,238, and 6,457,272, the trigger lock includes two blocking halves arranged on opposite sites of the trigger and the trigger guard. One blocking half at least a hole for receiving a corresponding locking rod affixed to the other blocking half. A lock cylinder mounted in one blocking half. The two blocking halves are attached on opposite sites of the trigger by the locking rod inserts into the hole and interlock with the cylinder.

However, the metal casing of conventional trigger locks for guns are made of copper through cutting and grinding. The raw material is expensive thus increasing the manufacturing cost. A lot of waste product also raise the cost. When being assembling, parts of the lock such as cylinder need to be mounted into the metal casing respectively. It's inconvenient and labor-consuming.

Moreover, the general locks don't have the waterproof structure so that the inner parts of the lock may get damaged due to the moisture. Thus causes users trouble and inconvenience.

SUMMARY OF THE INVENTION

It is therefore a primary object of the present invention to provide a trigger lock having a locking body and a plate mounted on opposite sides of the trigger of guns respectively so as to prevent the misuse and for gun safety.

In order to achieve the above object, the present invention provides a gun trigger lock having a main body of lock and a locking plate. The locking body is composed of a lock cylinder and a locking piece disposed inside a plastic core, then covered by a metal casing and a metal panel that are coated with a waterproof layer by injection molding. The locking plate has two locking rods installed on a metal plate. The surface of the locking plate is also covered with a waterproof layer by injection molding. The two locking rods on the metal plate are inserted into two inserting holes on the locking body so as to lock the trigger of gun.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DETAILED DESCRIPTION OF THE PREFERRED EMBODIMENT

Figure 1:
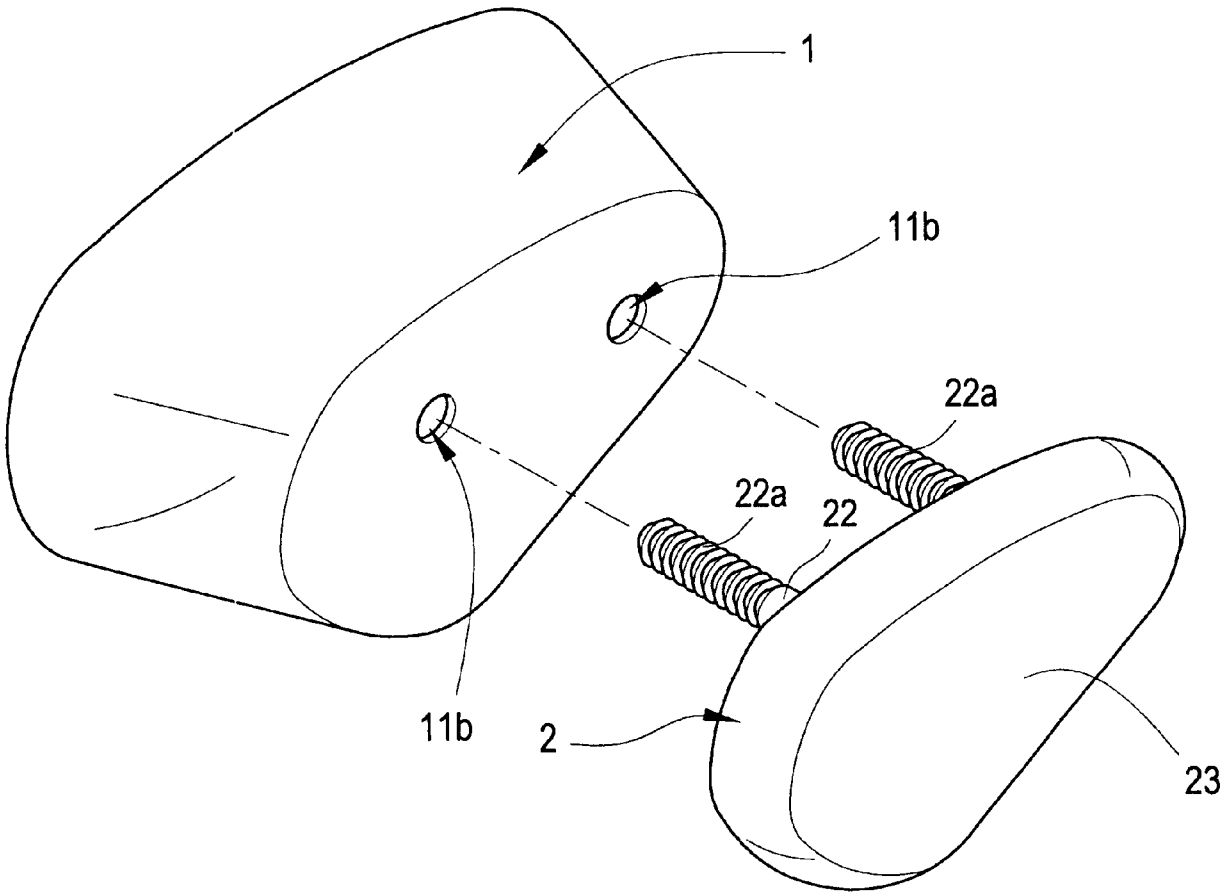
FIG. 1 is a perspective view of the present invention.
Figure 2:
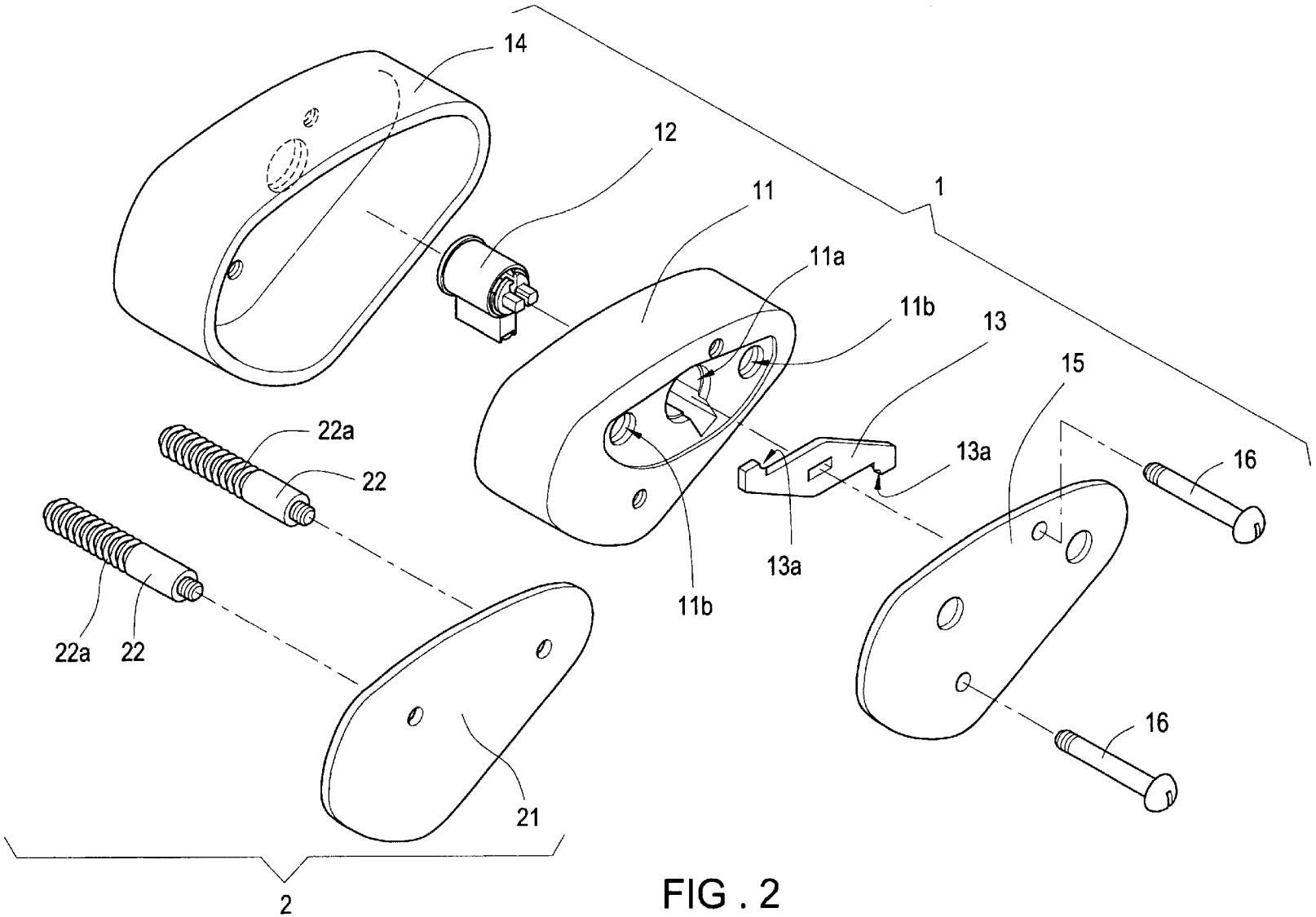
FIG. 2 is an explosive view of the present invention.
Figure 3:
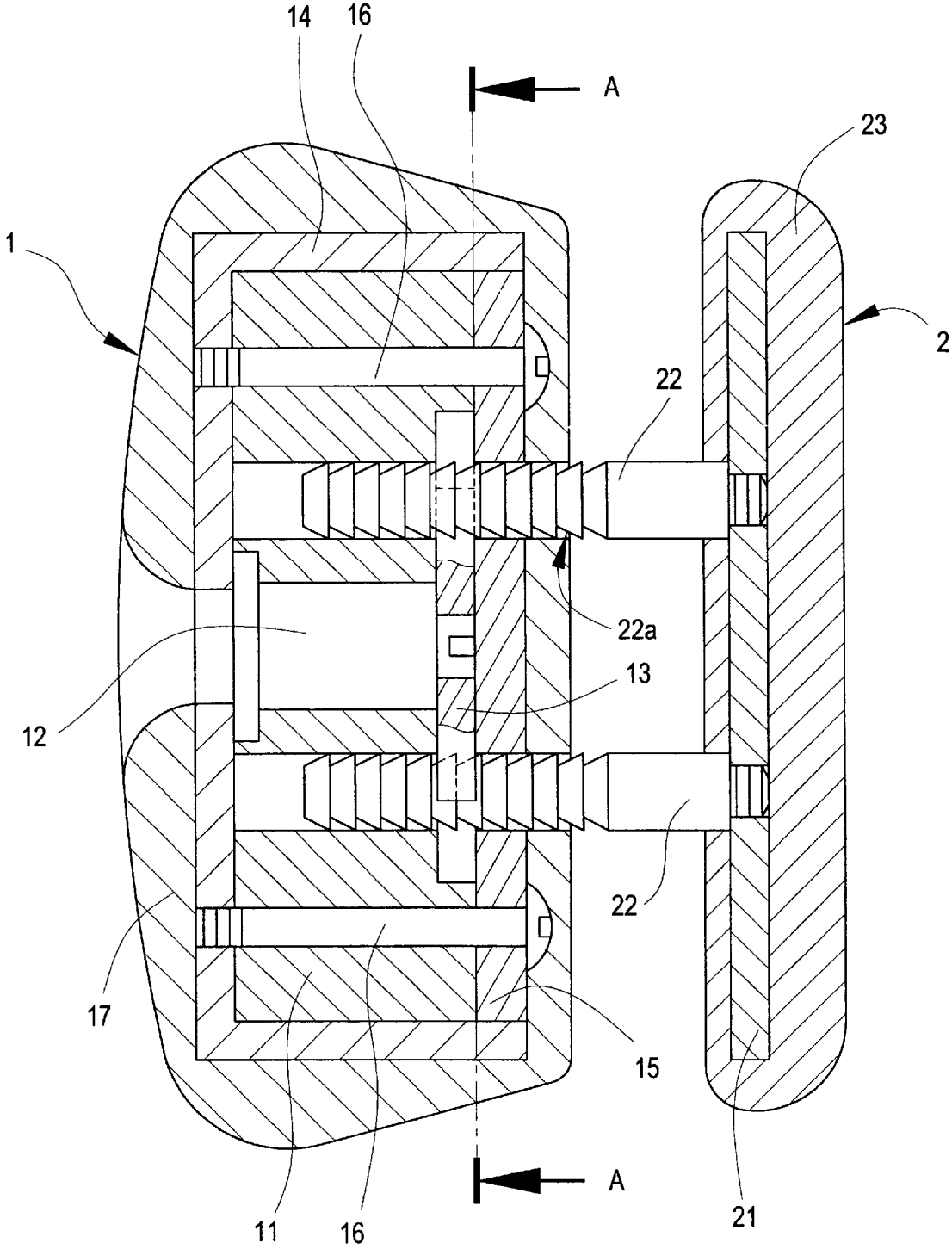
FIG. 3 is a cross-sectional view of the present invention.

Refer to FIG. 1, FIG. 2 & FIG. 3, the present invention is composed of a locking body 1 and a locking plate 2. The locking body 1 includes a plastic core 11 with a mounted hole 11*a* and two inserting holes 11*b*. A cylinder 12 is mounted in the mounted hole 11*a* while a locking piece 13 with short slopes 13*a* on two ends are disposed on top of the cylinder 12. A metal casing 14 that has been heat treated, in combination with a metal panel 15, covers the plastic core 11 inside. At least two bolts 16 insert through the metal panel 15, the plastic core 11, then screwed into the metal casing (casing) 14 so as to fix the plastic core 11 inside the metal casing 14 and the metal panel 15. Then a waterproof layer 17 is covered on the outer surface of the metal casing 14 and the metal panel 15 totally by injection molding so as to waterproofing and anti-sawing.

The locking plate 2 includes two locking rods 22 affixed on a metal plate 21. The distal end of the locking rod 22 is provided with a plurality of annular teeth 22*a*. Both the metal plate 21 and the lockin rods 22 have been heat treated. The metal plate 21 is also coated with a waterproof layer 23 by injection molding while the two locking rods 22 extends outward the waterproof layer 23.

Figure 4:
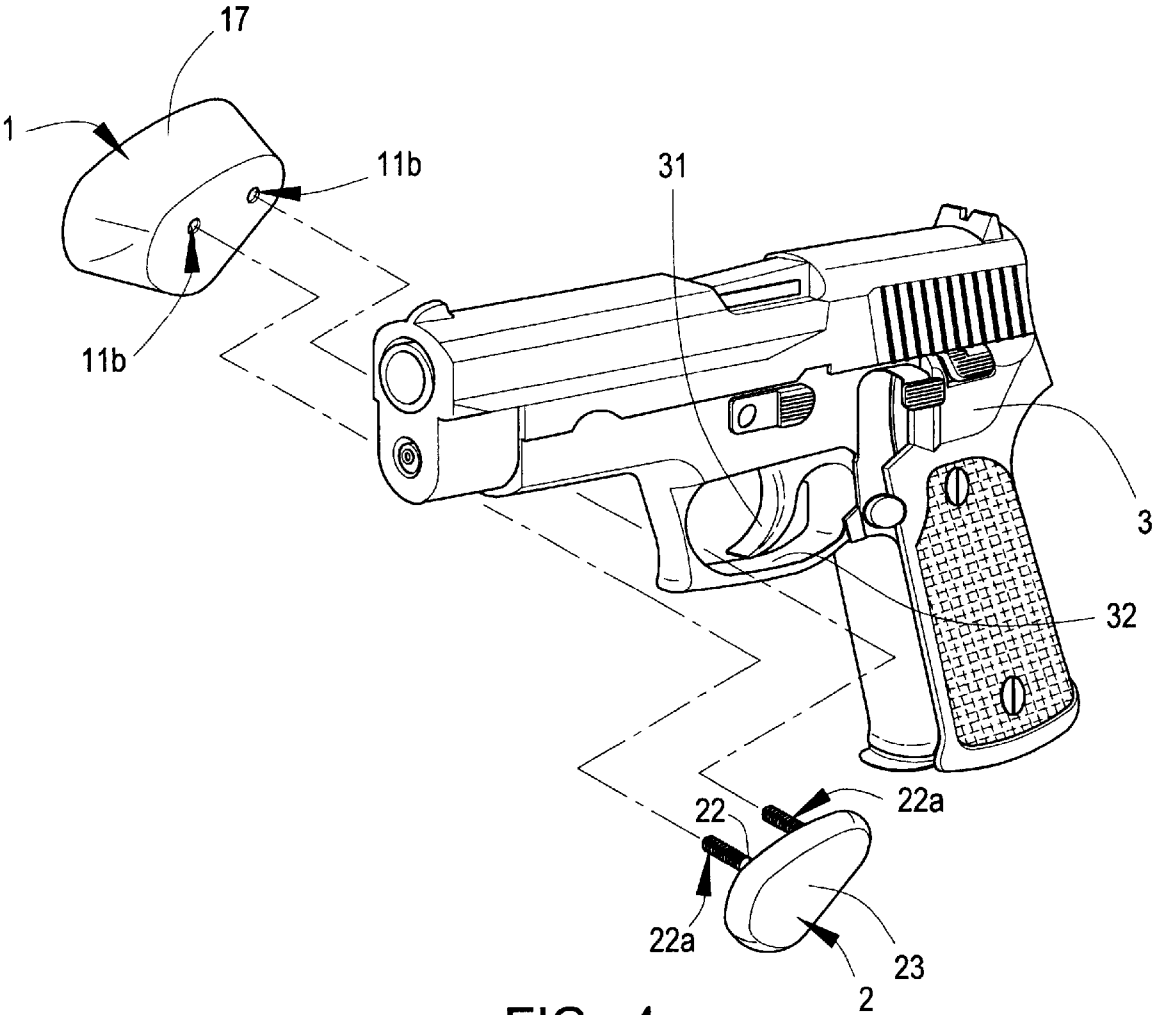
FIG. 4 is an explosive view of the present invention while being assembled on a gun.
Figure 5:
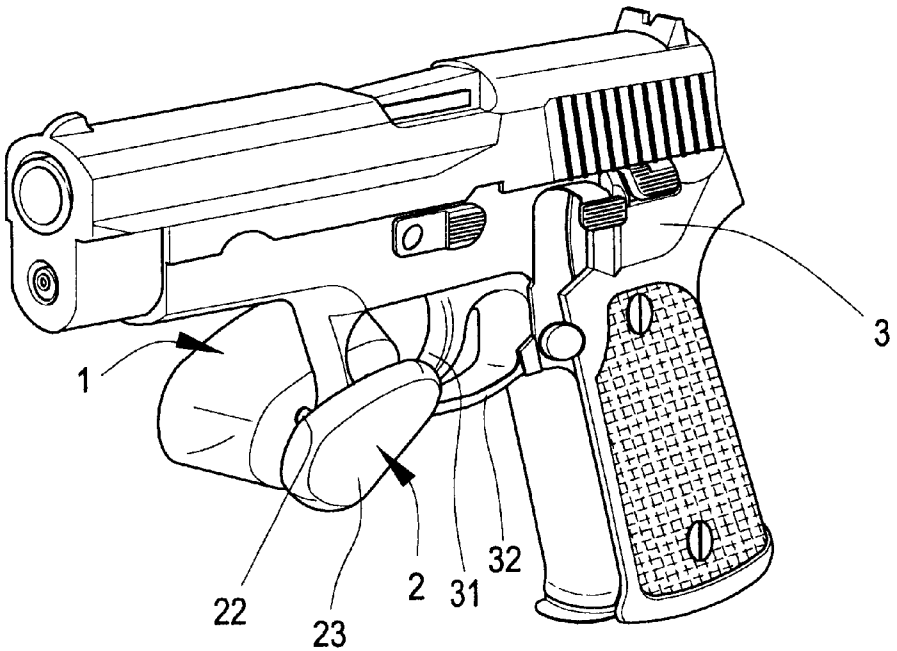
FIG. 5 is a perspective view of the present invention installed on a gun.
Figure 6:
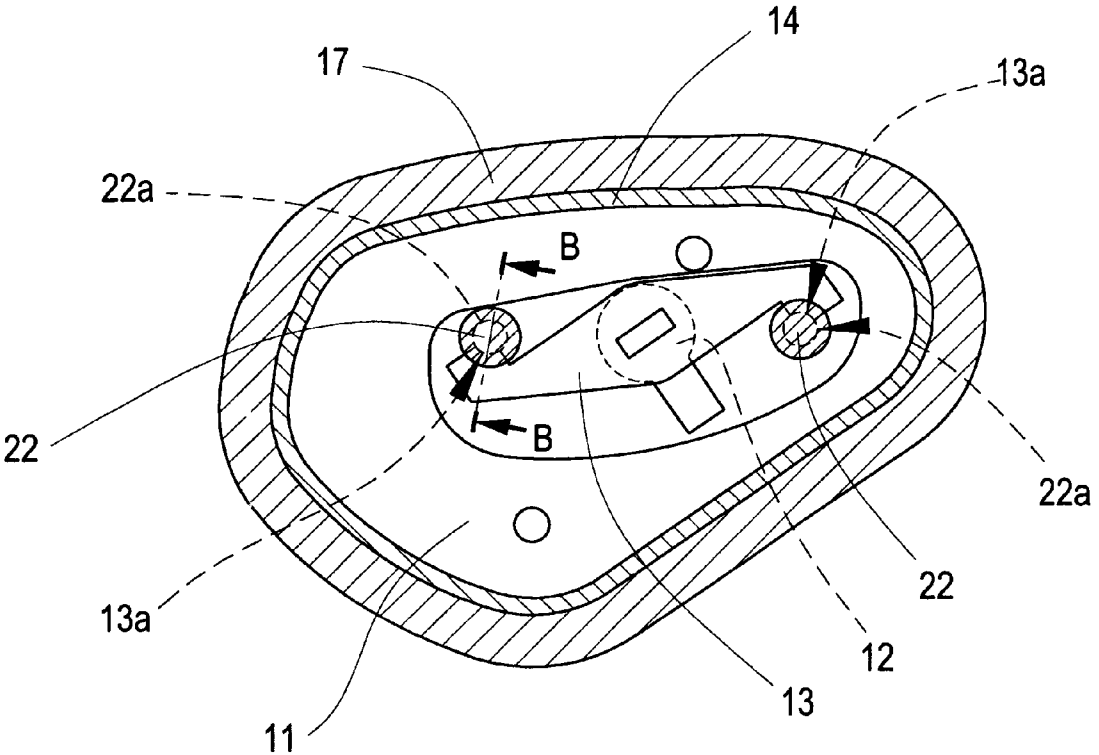
FIG. 6 is a cross-sectional view of FIG. 3 along the line A—A while a locking piece engages locking rods.
Figure 7:
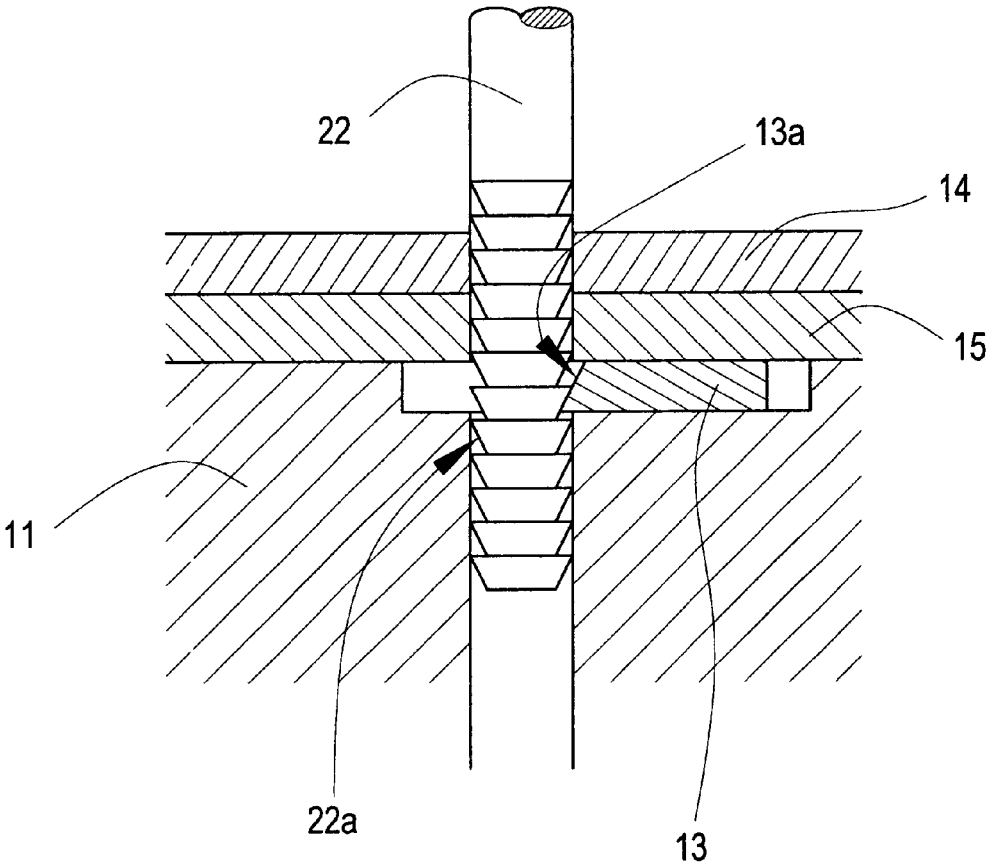
FIG. 7 is a cross-sectional view of FIG. 6 along the line B—B.

In accordance with the structure mentioned above, with reference of FIG. 4 & FIG. 5, the locking rods 22 on the locking plate 2 insert through a trigger guard 32 located beside a trigger 31 of the gun 3. One of the locking rods 22 is attached within the trigger guard 32 while the other one 22 is attached outside the trigger guard 32. Then the locking rods 22 thread into the two inserting holes 11*b* of the locking body 1. Refer to FIG. 6 & FIG. 7, the short slopes 13*a* on two ends of the locking piece 13 inside the locking body 1 interlock the annular teeth 22*a* on the locking rods 22 of the locking plate 2 so as to dispose the locking body 1 and the locking plate 2 on opposite sides of the trigger 31. Thus the invention safeguards the guns 3 from being misused by unauthorized persons.

Figure 8:
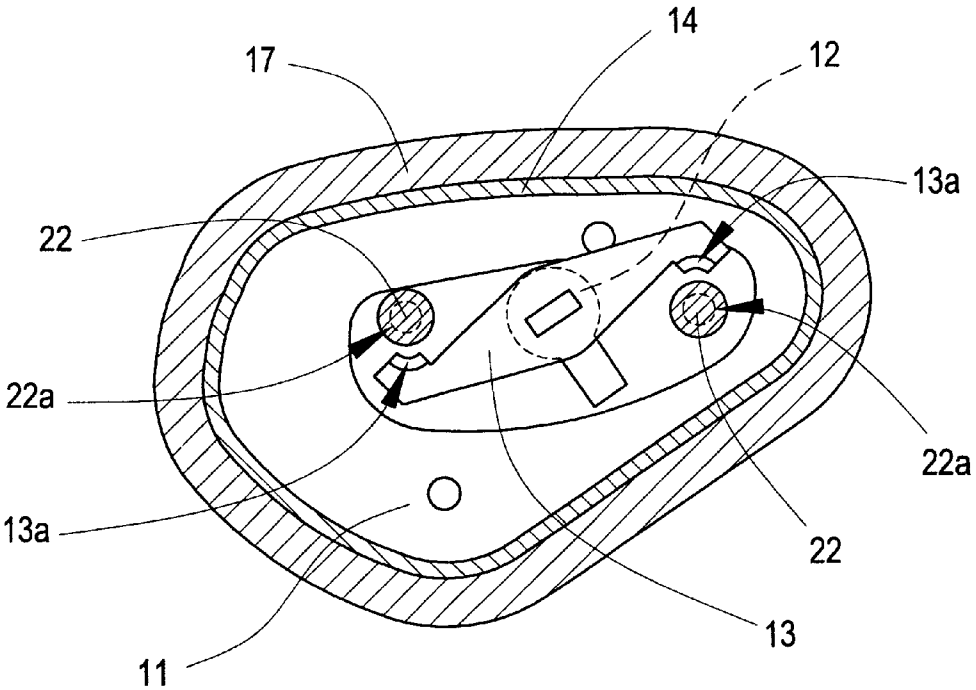
FIG. 8 is a cross-sectional view of FIG. 3 along the line A—A while the locking piece disengage the locking rods.

Moreover, when the gun 3 is used, a key (not shown in figure) is inserted into the cylinder 12 of the locking body 1 to rotate the cylinder 12, so as to remove the short slopes 13*a* on the locking piece 13 from the annular teeth 22*a* on distal end of the locking rods 22, as shown in FIG. 8, to allow the two locking rods 22 separate with the locking body 1. The locking body 1 and the locking plate 2 are both released from the gun 3.

Figure 9:
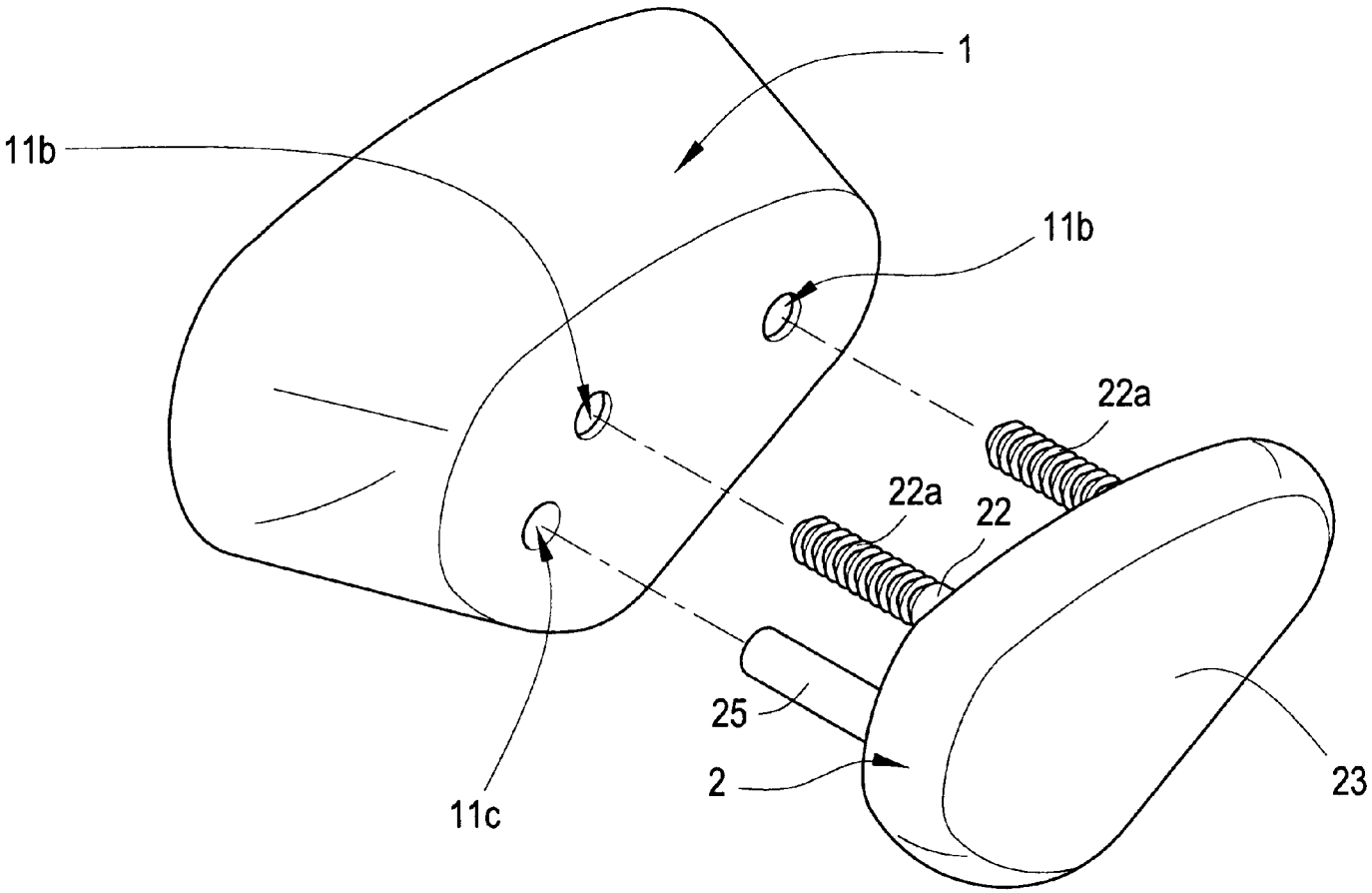
FIG. 9 is an explosive view of another embodiment of the present invention.
Figure 10:
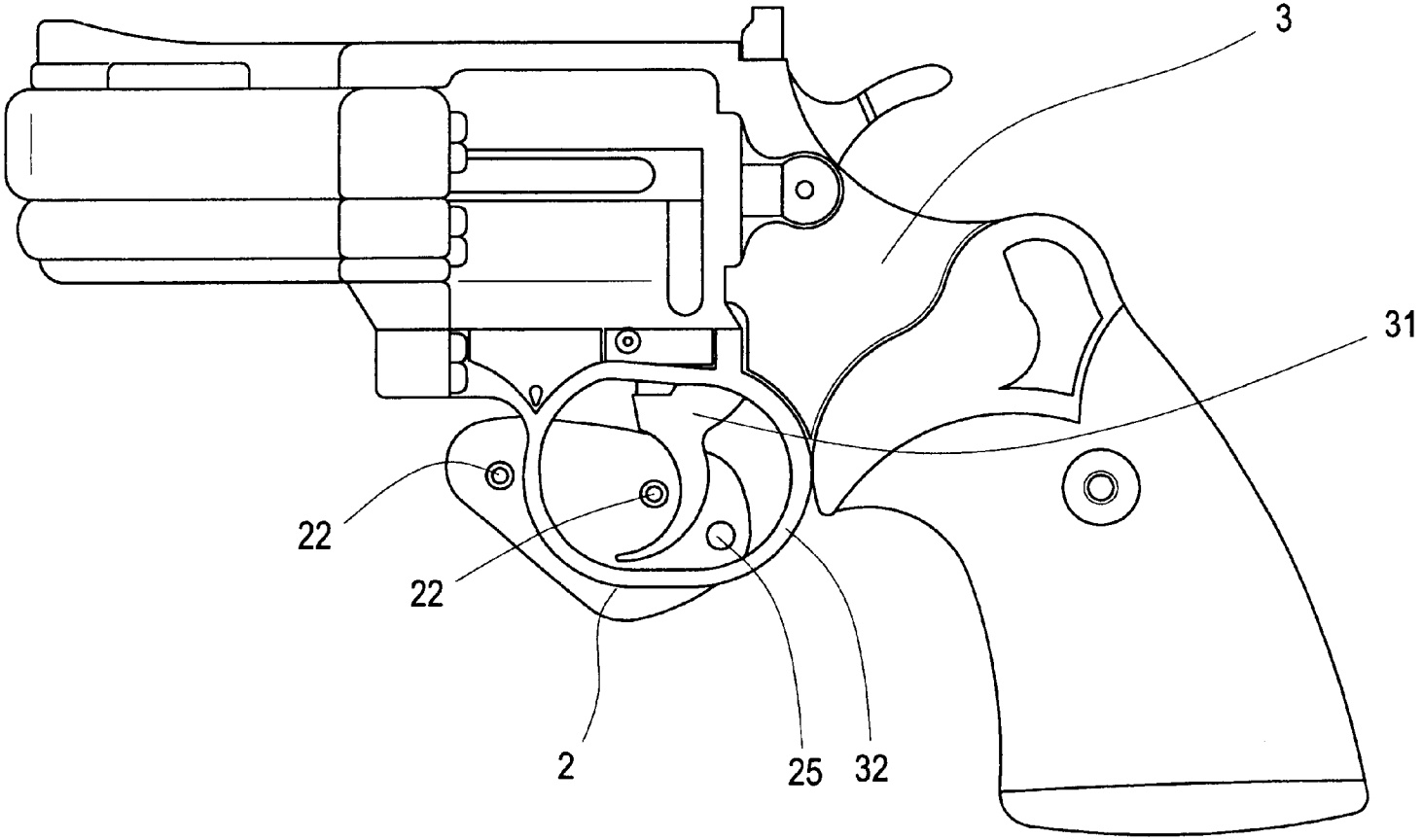
FIG. 10 is a schematic drawing of another embodiment of the present invention.

Refer to FIG. 9, a pin 25 is disposed on the bottom side of the locking plate 2 while a corresponding mounted hole

11*c* is arranged on the locking body 1. By the pin 25 insert through the trigger guard 32 into the mounted hole 11*c,* the locking body 1 connects with the locking plate 2 with the pin 25 located on the rear end of the trigger 31 so as to prevent the accidental discharges caused by the pulling of the trigger 31.

Furthermore, a waterproof layer 17 is coated on the surface of the locking body 1 by injection molding so as to prevent the parts such as the cylinder 12 inside from being damaged by the in leakage of water.

In addition, the locking body 1 is wrapped by the metal casing 14 and the metal panel 15 that have been heat treated so as to have higher hardness for antisawing. The metal plate 21 and the locking rods 22 also have been heat treated and thus more tough.

It should be noted that the above description and accompanying drawings are only used to illustrate some embodiments of the present invention, not intended to limit the scope thereof. Any modification of the embodiments should fall within the scope of the present invention.

What is claimed is:

1. A trigger lock comprising a locking body having a plastic core with a mounted hole and two inserting holes; a cylinder is mounted in the mounted hole while a locking piece with short slopes on two ends are disposed on top of the cylinder; a heat-treated metal casing in combination with a heat-treated metal panel, covers the plastic core inside; least two bolts insert through the metal panel, the plastic core, then screw into the metal casing so as to fix the plastic core inside the metal casing and the metal panel; a waterproof layer is coated on the outer surface of the metal casing and the metal panel totally by injection molding for waterproofing and anti-sawing;

a locking plate having two locking rods affixed on a metal plate, both the metal plate and the locking rods have been heat treated; the distal end of the locking rod is provided with a plurality of annular teeth; the metal plate is coated with a waterproof layer by injection molding while the two locking rods extends outward the waterproof layer;

by the two locking rods on a metal plate being threaded into the two inserting holes of the locking body and the short slopes of the locking piece inside the locking body interlocking the annular teeth on the locking rods, the locking body and the locking plate are mounted on opposite sides of the trigger so as to lock the trigger.

2. The trigger lock as claimed in claim 1, wherein a pin is disposed on the bottom side of the locking plate while a corresponding mounted hole is arranged on the locking body; by the pin inserting through a trigger guard into the mounted hole, the locking body connects with the locking plate with the pin located on the rear end of the trigger.

* * * * *